US011328880B2

(12) United States Patent
Lin et al.

(10) Patent No.: US 11,328,880 B2
(45) Date of Patent: May 10, 2022

(54) KEY

(71) Applicant: Chicony Electronics Co., Ltd., New Taipei (TW)

(72) Inventors: Chih-Ping Lin, New Taipei (TW); Shin-Chin Weng, New Taipei (TW); Shih-Yu Hsu, New Taipei (TW); Chih-Feng Chen, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 17/209,885

(22) Filed: Mar. 23, 2021

(65) Prior Publication Data

US 2022/0020543 A1 Jan. 20, 2022

(30) Foreign Application Priority Data

Jul. 17, 2020 (TW) ..... 109124351

(51) Int. Cl.
*H01H 3/12* (2006.01)
*H01H 13/7065* (2006.01)

(52) U.S. Cl.
CPC ..... *H01H 13/7065* (2013.01); *H01H 3/125* (2013.01)

(58) Field of Classification Search
CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS 6,444,933 B1 * 9/2002 Chun ..... H01H 3/125 200/344
2018/0075987 A1 * 3/2018 Tsai ..... H01H 3/12

FOREIGN PATENT DOCUMENTS

CN 110571084 A 12/2019

* cited by examiner

*Primary Examiner* — Ahmed M Saeed
(74) *Attorney, Agent, or Firm* — Muncy, Geissler, Olds & Lowe, P.C.

(57) ABSTRACT

A key includes a substrate, a keycap, a connection component, and protruding structures. The connection component includes a first connection member and a second connection member, and the first connection member and the second connection member are between the substrate and the keycap. The protruding structures are disposed on the upper surface of the first connection member and disposed on the upper surface of the second connection member. When the keycap is pressed to a pressed position, the protruding structures on the first connection member and on the second connection member abut against the bottom surface of the keycap, so that a gap is formed between the keycap and the connection component. Therefore, the bottom surface of the keycap does not contact the upper surface of the first connection member and the upper surface of the second connection member so as to prevent from generating keystroke noises.

10 Claims, 12 Drawing Sheets

KEY

CROSS-REFERENCE TO RELATED APPLICATION

This non-provisional application claims priority under 35 U.S.C. § 119(a) to Patent Application No. 109124351 filed in Taiwan, R.O.C. on Jul. 17, 2020, the entire contents of which are hereby incorporated by reference.

BACKGROUND

Technical Field

The instant disclosure relates to a key, in particular, to a key with reduced keystroke noise.

Related Art

For keys applied to a keyboard, the keycap of the key and the substrate of the key are movably connected with each other through the structure of a scissor connection component. For a key having a scissor connection component known to the inventor, when the key is pressed, the upper surface of the scissor connection component bumps the inner surface of the key so as to generate keystroke noise, especially in the case that the keys are stroked quickly, such phenomenon is apparent. The noise is annoying.

SUMMARY

In view of this, in one embodiment, a key is provided. The key comprises a substrate, a keycap, a connection component, and a plurality of protruding structures. The keycap is on the substrate. The connection component comprises a first connection member and a second connection member. The first connection member and the second connection member are between the substrate and the keycap. One of two ends of the first connection member is connected to the substrate, and the other end of the first connection member is connected to the keycap. One of two ends of the second connection member is connected to the substrate, and the other end of the second connection member is connected to the keycap. The protruding structures are disposed on an upper surface of the first connection member, or the protruding structures are disposed on an upper surface of the second connection member, or the protruding structures are disposed on the upper surface of the first connection member and the upper surface of the second connection member. Each of the protruding structures faces a bottom surface of the keycap. When the keycap is pressed to a pressed position, the bottom surface of the keycap contacts the protruding structures, and the protruding structures abut against the keycap, so that a gap is formed between the keycap and the connection component.

In one or some embodiments, each of the protruding structures contacts the bottom surface of the keycap in a point-contact manner, in a line-contact manner, or in a surface-contact manner.

In one or some embodiments, each of the protruding structures is a curved structure, a circular cone structure, a sphere structure, a circular cylinder structure, or a elongate rib structure.

In one or some embodiments, the first connection member comprises an inner frame body, and the second connection member comprises an outer frame body. The protruding structures are disposed on an upper surface of the inner frame body and on side arms of the inner frame body, or the protruding structures are disposed on an upper surface of the outer frame body and on side arms of the outer frame body, or the protruding structures are disposed on the upper surface of the inner frame body and on the side arms of the inner frame body and are disposed on the upper surface of the outer frame body and on the side arms of the outer frame body.

In one or some embodiments, when the keycap is pressed to the pressed position, the first connection member and the second connection member are arranged laterally with respect to the keycap and are not in parallel in a side view of the key.

In one or some embodiments, two sides of the other end of the first connection member have two first upper shaft portions, and two sides of the other end of the second connection member have two second upper shaft portions. The first upper shaft portions are respectively assembled with pivoting holes of the keycap, and the second upper shaft portions are respectively assembled with reversed hooks of the keycap.

In one or some embodiments, the protruding structures are disposed on the upper surface of the first connection member and adjacent to the first upper shaft portions, or the protruding structures are disposed on the upper surface of the second connection member and adjacent to the second upper shaft portions, or the protruding structures are disposed on the upper surface of the first connection member and adjacent to the first upper shaft portions and are disposed on the upper surface of the second connection member and adjacent to the second upper shaft portions.

In one or some embodiments, the protruding structures are disposed on the other end of the first connection member, and a center point of each of the protruding structures and a center point of the corresponding first upper shaft portion are a same center point or are different center points.

In one or some embodiments, the protruding structures are disposed on the other end of the second connection member, and a center point of each of the protruding structures and a center point of the corresponding second upper shaft portion are a same center point or are different center points.

In one or some embodiments, when the keycap is at an abutted position, the bottom surface of the keycap contacts the protruding structures, and the protruding structure contact the keycap, so that no gap is formed at a connection portion between the keycap and the protruding structures.

In one or some embodiments, when the keycap is moved from the abutted position to the pressed position, the bottom surface of the keycap continuously contacts a surface of a curved structure of each of the protruding structures.

According to one or some embodiments of the instant disclosure, when the keycap is pressed to the pressed position, the protruding structures on the first connection member and the second connection member abut against the bottom surface of the keycap, and the protruding structures abut against the keycap, so that a gap is formed between the keycap and the connection component. Hence, the bottom surface of the keycap cannot contact the upper surface of the first connection member and the upper surface of the second connection member, so that the stroke noise generated by the contact between surfaces can be prevented. Accordingly, the stroke noise can be reduced. Moreover, when the keycap is at the abutted position, the bottom surface of the keycap contacts the protruding structures, so that no gap is formed at a connection portion between the keycap and the protruding structures, thereby reducing the stroke noise.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
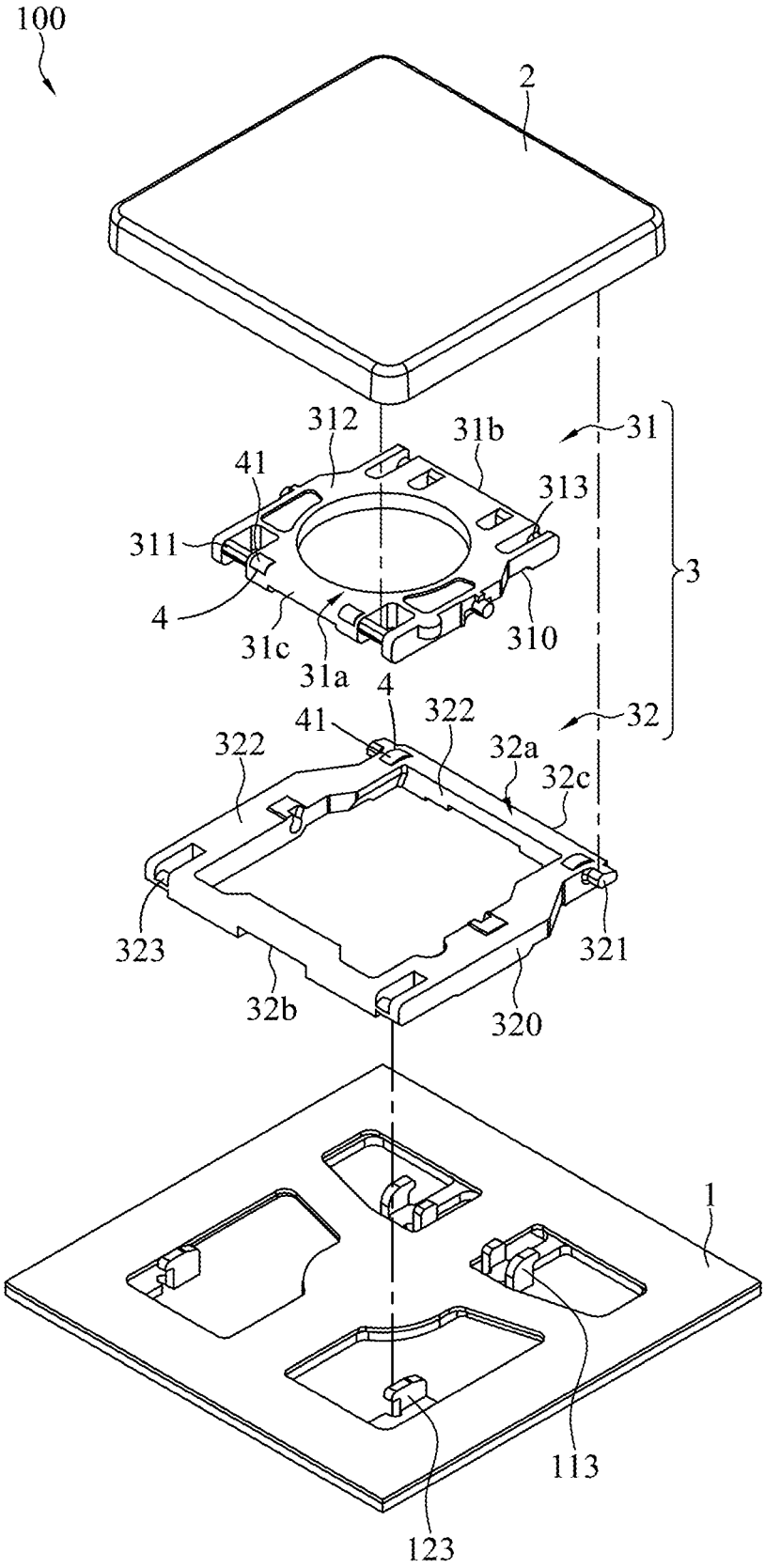
FIG. 1 illustrates a front exploded view of a key according to an exemplary embodiment of the instant disclosure.
Figure 2:
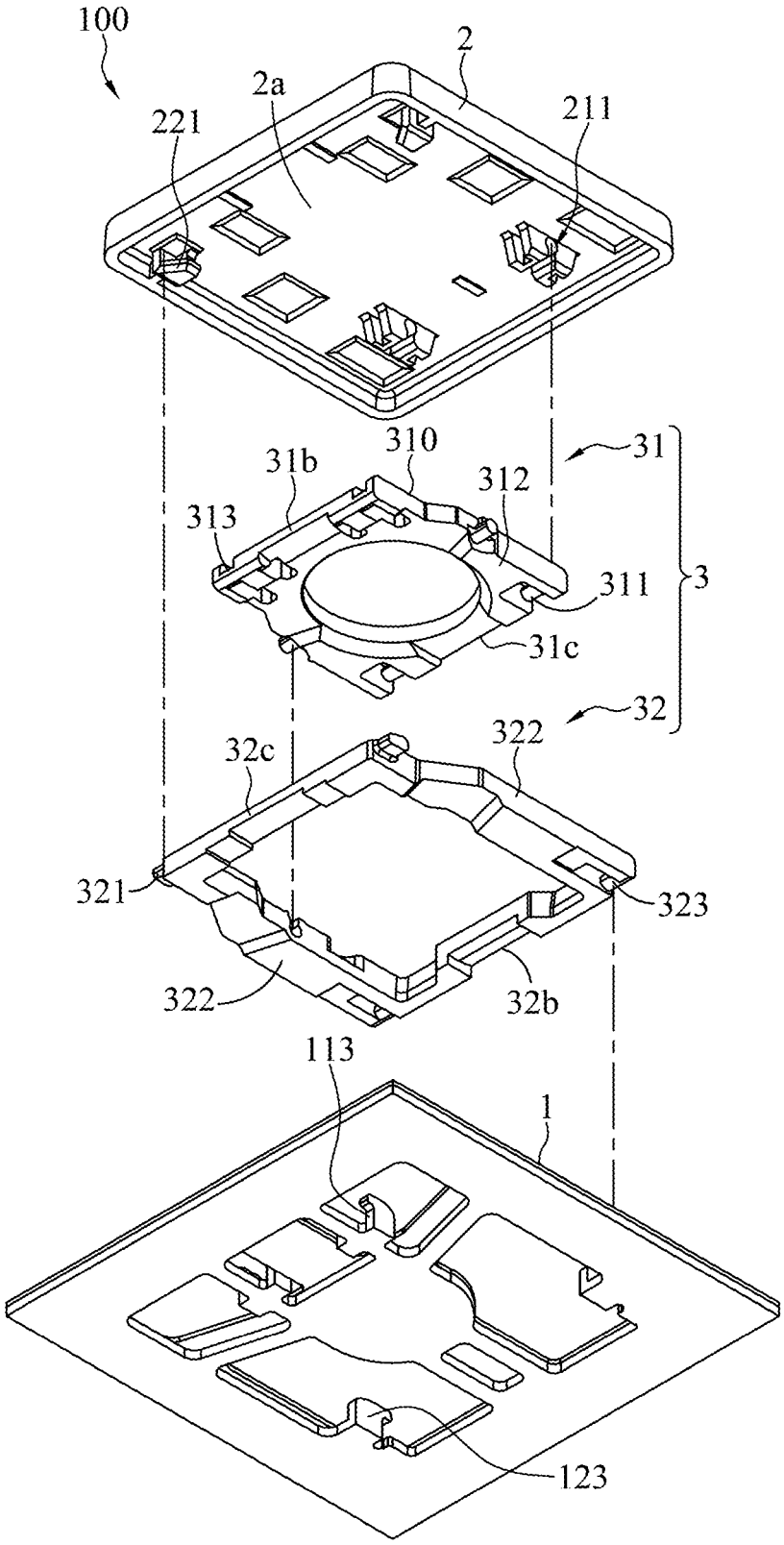
FIG. 2 illustrates a rear exploded view of the key of the exemplary embodiment.

Please refer to FIGS. 1 and 2. A key 100 according to an exemplary embodiment of the instant disclosure is illustrated. FIG. 1 illustrates a front exploded view of the key 100 of the exemplary embodiment, and FIG. 2 illustrates a rear exploded view of the key 100 of the exemplary embodiment. In this embodiment, the key 100 comprises a substrate 1, a keycap 2, a connection component 3, and a plurality of protruding structures 4.

Figure 3A:
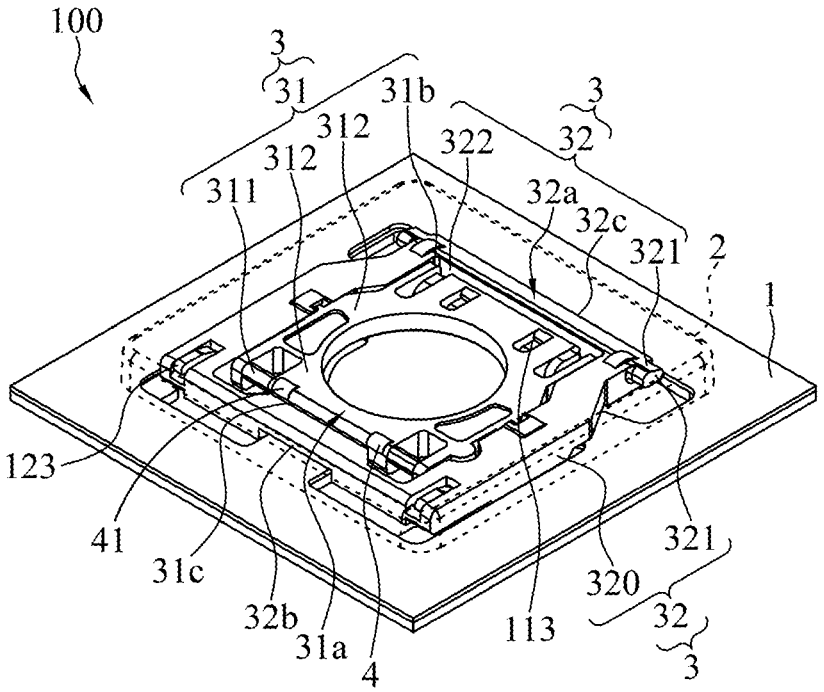
FIG. 3A illustrates a schematic perspective view showing that the key of the exemplary embodiment is pressed.
Figure 3B:
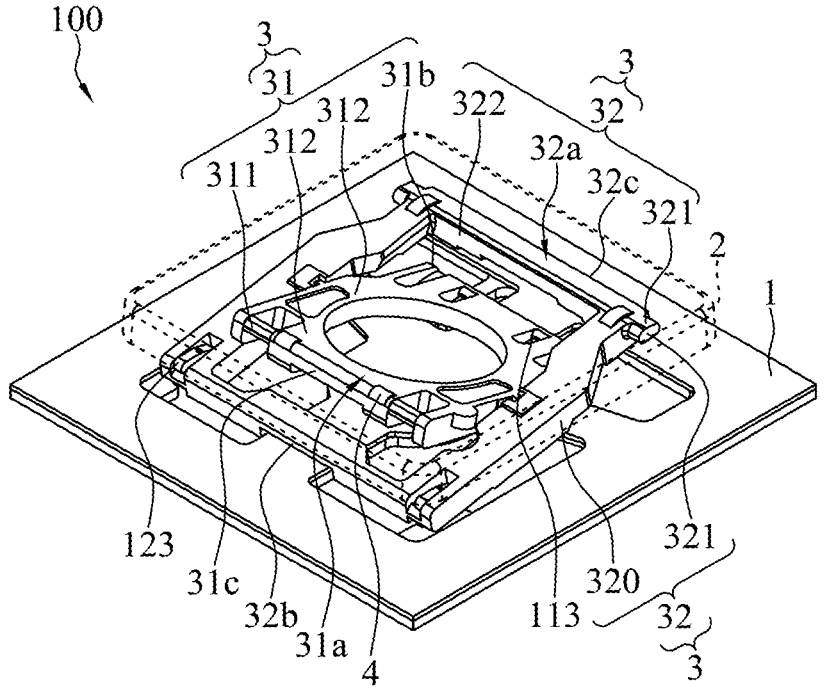
FIG. 3B illustrates a schematic perspective view showing that the key of the exemplary embodiment is not pressed.

Please refer to FIGS. 1 to 3A. FIG. 3A illustrates a schematic perspective view showing that the key 100 is pressed. In this embodiment, the substrate 1 is provided for supporting the keycap 2, the connection component 3, or other components not shown in the figures (for example, resilient members (e.g., rubber domes, metal domes, or elastic pieces)). The keycap 2 is disposed above the substrate 1, and the keycap 2 is disposed on the substrate 1 through the connection component 3. More specifically, in this embodiment, the substrate 1 may be formed by a bottom layer and a circuit layer. The circuit layer has a conduction portion for conduction after the keycap 2 is pressed, so that the motions of pressing the keycap 2 can be converted into signals, so that the signals are then inputted to the circuit layer. The connection component 3 is movably connected between the substrate 1 and the keycap 2 so as to aid the keycap 2 to move reciprocatingly with respect to the substrate 1. Accordingly, when a user presses the keycap 2, the keycap 2 can be moved toward the substrate 1. Conversely, the keycap 2 can be moved back to the original position of the keycap 1 with a resilient member (not shown). When the keycap 2 is pressed by the user, the resilient member is forced to deform and the elastic force is stored in the resilient member. When the keycap 2 is released, the keycap 2 can be moved back to the original position of the keycap 2 by the elastic force stored in the resilient member.

Figure 4:
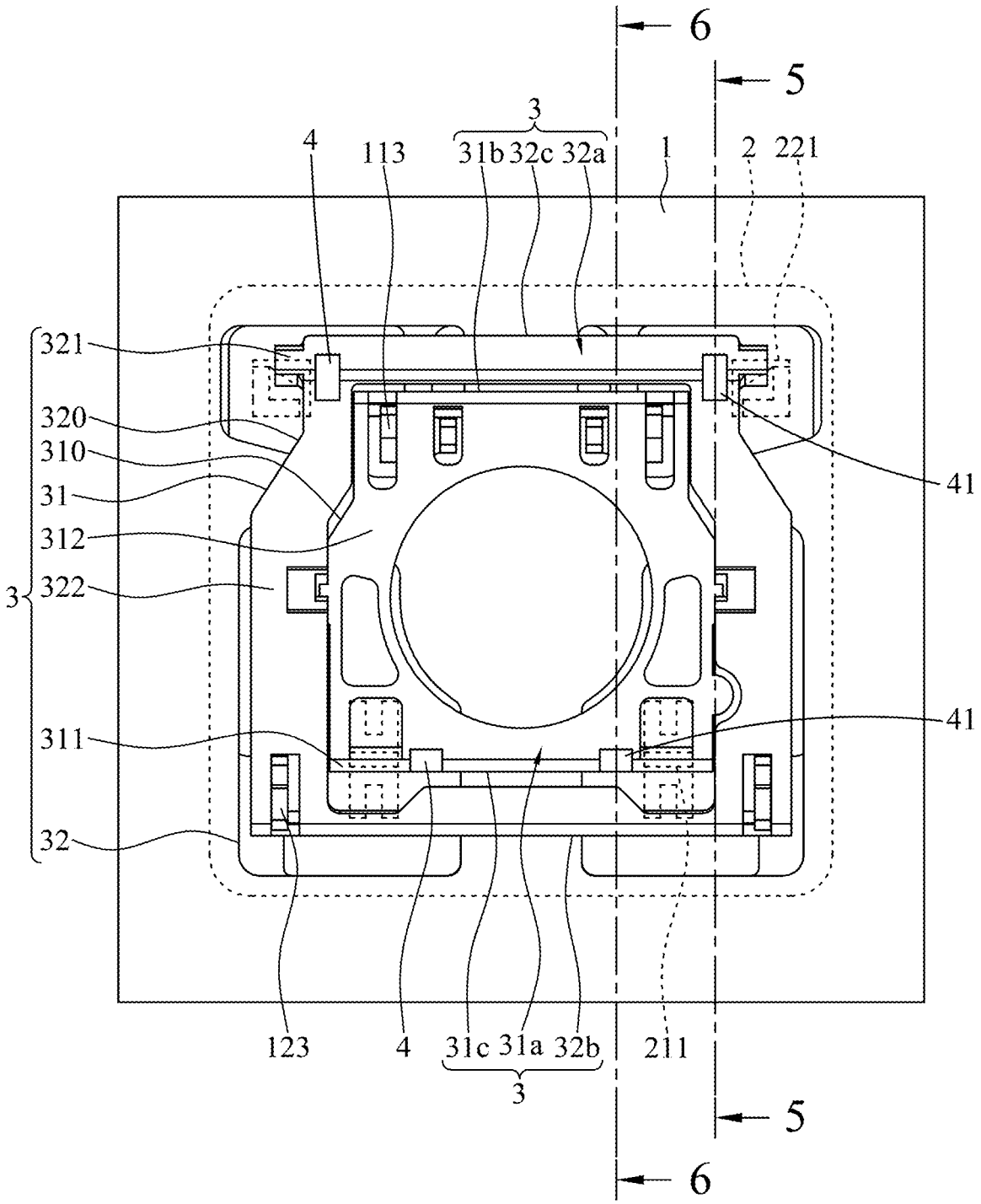
FIG. 4 illustrates a top view of the key of the exemplary embodiment.

Please refer to FIGS. 1, 2, and 4. More specifically, in this embodiment, the connection component 3 comprises a first connection member 31 and a second connection member 32 pivoted with each other. The first connection member 31 has a through hole for receiving the resilient member (not shown), and the second connection member 32 has a hollow portion for receiving the first connection member 31. More specifically, in this embodiment, the first connection member 31 and the second connection member 32 are both rectangular frame structures. In this embodiment, the first connection member 31 comprises an inner frame body 310, the second connection member 32 comprises an outer frame body 320, and the outer frame body 320 is at an outer periphery of the inner frame body 310.

Please further refer to FIG. 3A. More specifically, in this embodiment, each of four sides of the inner frame body 310 has a side arm 312, and each of four sides of the outer frame body 320 has a side arm 322. In this embodiment, the protruding structures 4 are disposed on an upper surface 31*a* of the inner frame body 310 and on two sides of one of the side arms 312 of the inner frame body 310, and the protruding structures 4 are disposed on an upper surface 32*a* of the outer frame body 320 and on two sides of the one of the side arms 322 of the outer frame body 320. In other words, in this embodiment, two protruding structures 4 are disposed on one of the side arms 312 of the inner frame body 310, and two protruding structures 4 are disposed on one of the side arms 322 of the outer frame body 320, but embodiments are not limited thereto. In some embodiments, one protruding structure 4 is disposed on one of the side arms 312 of the inner frame body 310, and one protruding structure 4 is disposed on one of the side arms 322 of the outer frame body 320. More specifically, the protruding structures 4 are disposed on the upper surface 31*a* of the first connection member 31 and adjacent to first upper shaft portions 311 of the first connection member 31, or the protruding structures 4 are disposed on the upper surface 32*a* of the second connection member 32 and adjacent to second upper shaft portions 321 of the second connection member 32, or the protruding structures 4 are disposed on the upper surface 31*a* of the first connection member 31 and adjacent to the first upper shaft portions 311 of the first connection member 31 and are disposed on the upper surface 32*a* of the second connection member 32 and adjacent to the second upper shaft portions 321 of the second connection member 32. In other words, in this embodiment, two protruding structures 4 are disposed on two sides of one of the side arms 312 of the first connection member 31 and adjacent to the first upper shaft portions 311, and two protruding structures 4 are disposed on two sides of one of the side arms 322 of the second connection member 32 and adjacent to the second upper shaft portions 321, but embodiments are not limited thereto. More specifically, in this embodiment, the protruding structures 4 are disposed on the first connection member 31 and adjacent to inner portions of the first upper shaft portions 311 at two sides of the first connection member 31. The first upper shaft portion 311 is at the corner of the first connection member 31 and corresponds to the adjacent corner of the keycap 2 above the connection component 3. When the corner of the keycap 2 is pressed for testing, the keycap 2 is pressed to a pressed position P1, the outer periphery of a bottom surface 2*a* of the keycap 2 contacts the protruding structures 4, and the protruding structures 4 abut against the keycap 2, so that a gap D1/D2 is formed between the keycap 2 and the connection component 3 (as shown in FIGS. 7A and 7B).

Figure 5A:
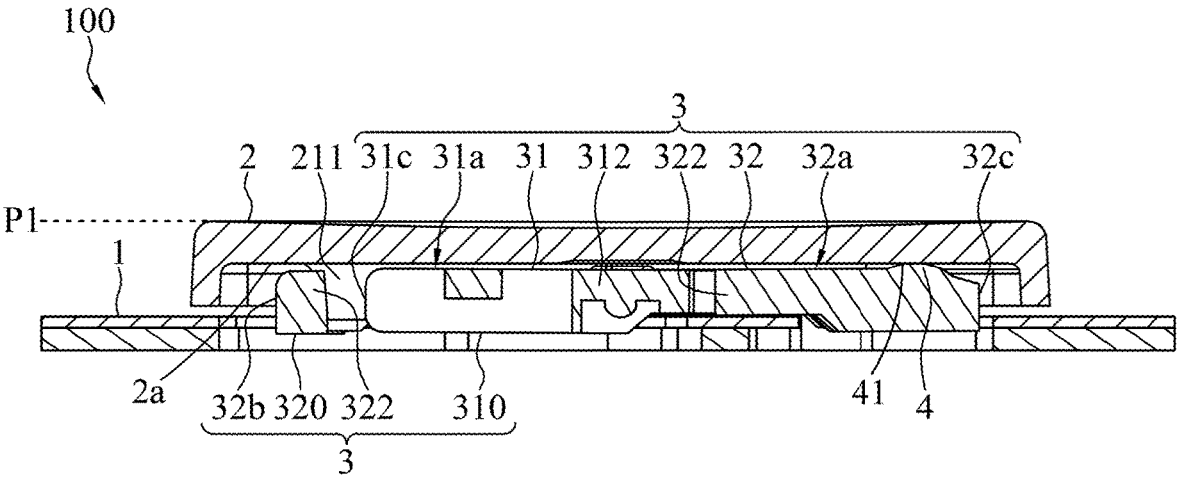
FIG. 5A illustrates a side cross-sectional view showing that the portion 5-5 shown in FIG. 4 is pressed.
Figure 5B:
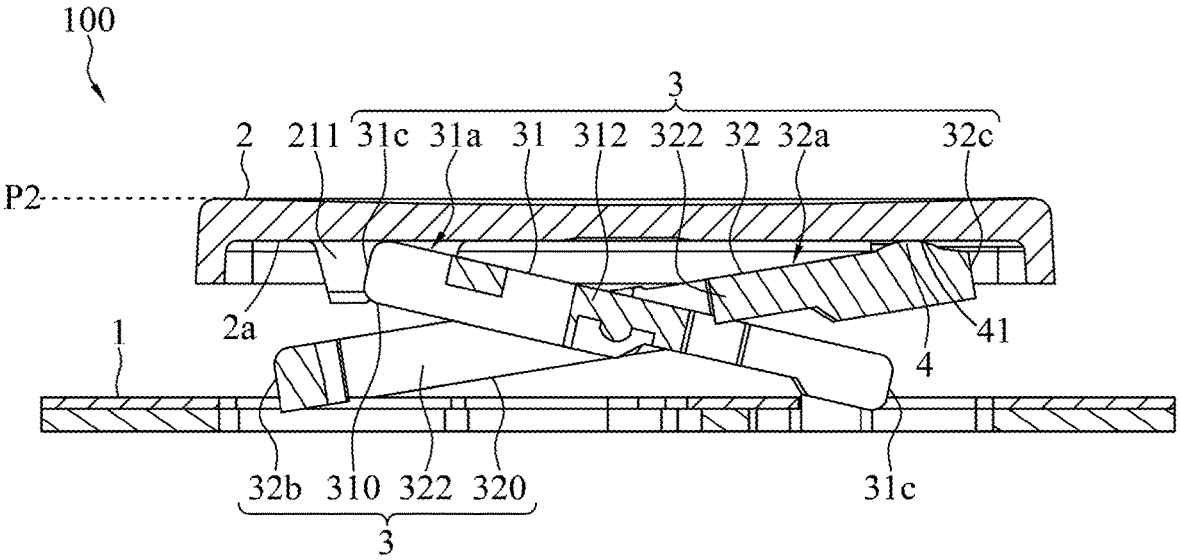
FIG. 5B illustrates a side cross-sectional view showing that the portion 5-5 shown in FIG. 4 is not pressed.
Figure 6A:
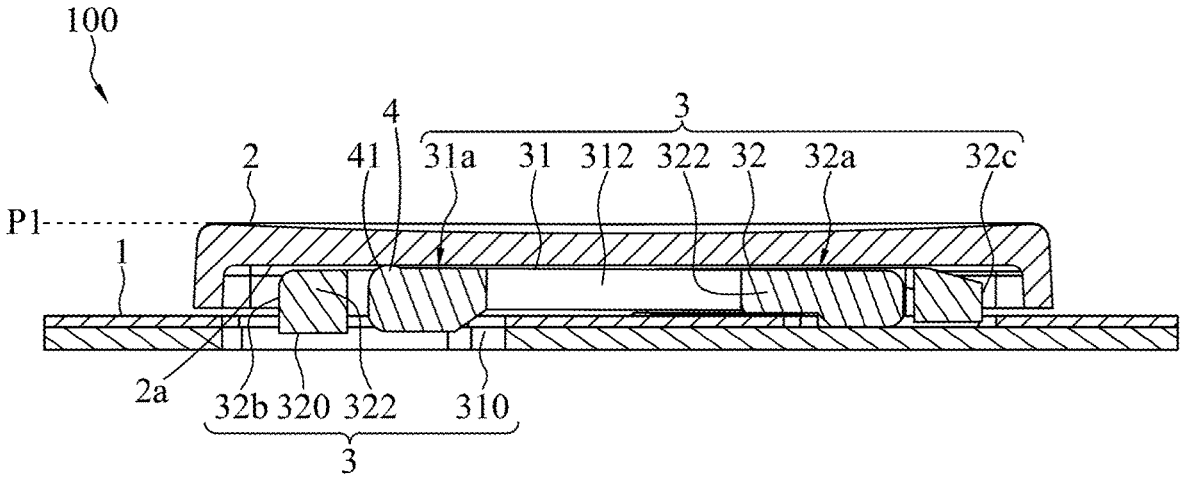
FIG. 6A illustrates a side cross-sectional view showing that the portion 6-6 shown in FIG. 4 is pressed.
Figure 6B:
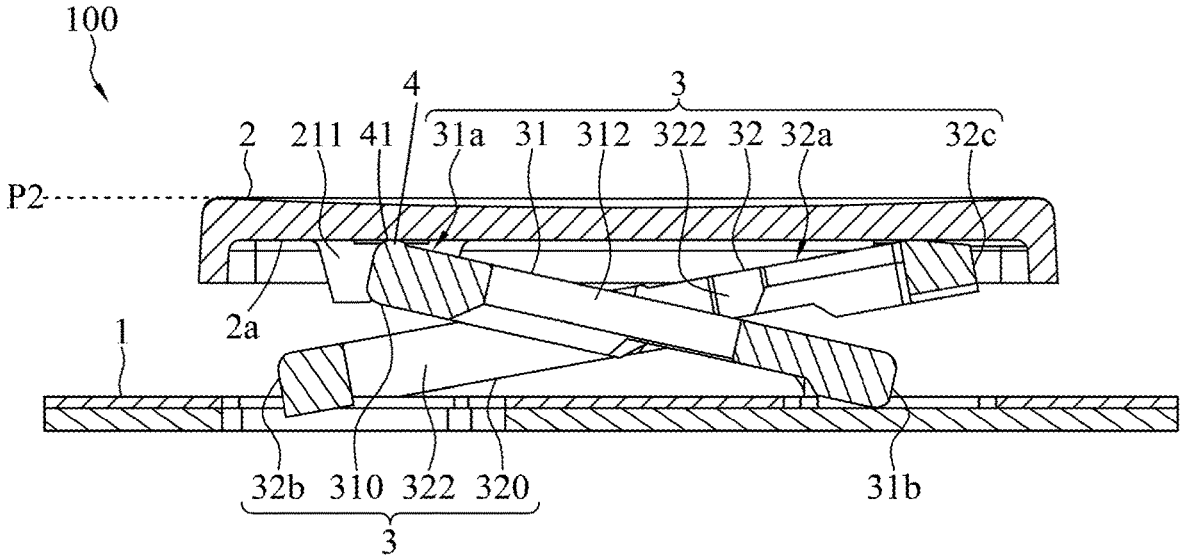
FIG. 6B illustrates a side cross-sectional view showing that the portion 6-6 shown in FIG. 4 is not pressed.

Next, please refer to FIGS. 1 to 5B. FIG. 3B illustrates a schematic perspective view showing that the key 100 is not pressed. FIG. 4 illustrates a top view of the key 100. FIG. 5A illustrates a side cross-sectional view showing that the portion 5-5 shown in FIG. 4 is pressed. FIG. 5B illustrates a side cross-sectional view showing that the portion 5-5 shown in FIG. 4 is not pressed. In this embodiment, the connection component 3 comprises a first connection member 31 and a second connection member 32. The first connection member 31 and the second connection member 32 are disposed between the substrate 1 and the keycap 2. Moreover, one end 31*b* of two ends of the first connection member 31 is connected to the substrate 1, and the other end 31*c* of the two ends of the first connection member 31 is connected to the keycap 2. Similarly, one end 32*b* of two ends of the second connection member 32 is connected to the substrate 1, and the other end 32*c* of the two ends of the second connection member 32 is connected to the keycap 2. The protruding structures 4 are respectively disposed on the upper surface 31*a* of the first connection member 31 and on the upper surface 32*a* of the second connection member 32. That is, in this embodiment, the protruding structures 4 are disposed above both the first connection member 31 and the second connection member 32 (corresponding to the bottom surface 2*a* of the keycap 2), but embodiments are not limited thereto. In some embodiments, the protruding structures 4 may be disposed on the upper surface 31*a* of the first connection member 31 or disposed on the upper surface 32*a* of the second connection member 32. Moreover, each of the protruding structures 4 faces the bottom surface 2*a* of the keycap 2.

Please refer to FIGS. 1, 2, 3A, 3B, 5B, and 6B. More specifically, in this embodiment, the inner frame body 310 and the outer frame body 320 are pivoted with each other to form the connection component 3 in an X-shape (scissor type), but embodiments are not limited thereto. In practices, the connection component 3 may be replaced by other structures having similar functions (functions for driving the keycap 2 to move up and down with respect to the substrate 1), for example, the connection component 3 may be a connecting rod structure in V-shape or A-shape. More specifically, in this embodiment, the end 31*b* of the first connection member 31 comprises first lower shaft portions 313, and the end 31*c* of the first connection member 31 comprises first upper shaft portions 311. Similarly, the end 32*b* of the second connection member 32 comprises second lower shaft portions 323, and the end 32*c* of the second connection member 32 comprises second upper shaft portions 321. The first lower shaft portions 313 of the first connection member 31 are assembled with hook portions 113 on the substrate 1, and the second lower shaft portions 323 of the second connection member 32 are respectively assembled with hook portions 123 on the substrate 1. More specifically, the first upper shaft portions 311 of the first connection member 31 are respectively assembled with pivot holes 211 of the bottom surface 2*a* of the keycap 2, and the second upper shaft portions 321 of the second connection member 32 are respectively assembled with reverse hooks 221 of the bottom surface 2*a* of the keycap 2. In this embodiment, each of the first upper shaft portions 311 and the corresponding pivot hole 211 are pivotally connected with each other to form a fixed side of the keycap 2. Conversely, each of the second upper shaft portions 321 and the corresponding reverse hook 221 are limited with each other in a loose manner to form a slidable side of the keycap 2. Accordingly, the connection component 3 is movably connected between the substrate 1 and the keycap 2.

Figure 7A:
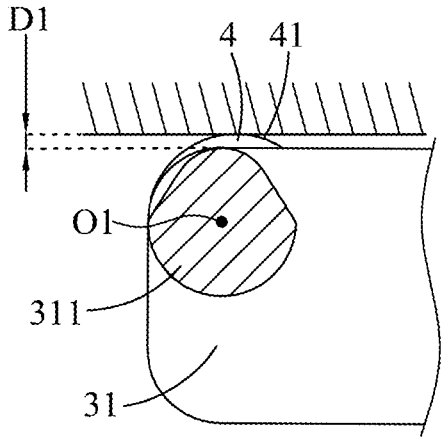
FIG. 7A illustrates a partial side cross-sectional view showing a portion of one embodiment of a first upper shaft portion of the key.
Figure 7B:
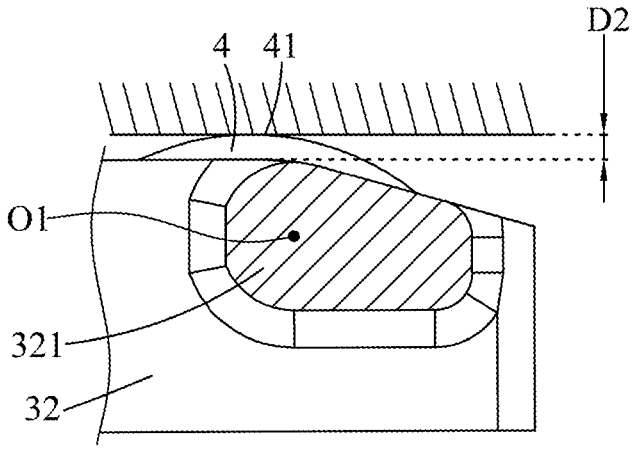
FIG. 7B illustrates a partial side cross-sectional view showing a portion of one embodiment of a second upper shaft portion of the key.

Please refer to FIGS. 1, 2, 7A, and 7B. More specifically, in this embodiment, the side portion of the first connection member 31 forms a groove, and the first upper shaft portions 311 are formed in the groove, and each of the first upper shaft portions 311 is configured as a lateral shaft structure. Moreover, as shown in FIG. 7A, the cross-sectional area of the shaft structure is approximately in a round shape, and two sides of the upper portion of the cross-sectional area of the shaft structure are inclined. Each of the second upper shaft portions 321 is a bump structure disposed on an outer side surface of the second connection member 32. Similarly, as shown in FIG. 7B, the cross-sectional area of the bump structure is approximately in a laid-down trapezoid shape, and the upper edge of the cross-sectional area of the bump structure and the lower edge of the cross-sectional area of the bump structure are not in parallel (in this embodiment, the lower edge of the cross-sectional area of the bump structure is configured horizontally, and the upper edge of the cross-sectional area of the bump structure is configured inclinedly).

Please refer to FIG. 1 to FIG. 7B. FIG. 6A illustrates a side cross-sectional view showing that the portion 6-6 shown in FIG. 4 is pressed. FIG. 6B illustrates a side cross-sectional view showing that the portion 6-6 shown in FIG. 4 is not pressed. FIG. 7A illustrates a partial side cross-sectional view showing a portion of one embodiment of the first upper shaft portion 311 of the key 100. FIG. 7B illustrates a partial side cross-sectional view showing a portion of one embodiment of the second upper shaft portion 321 of the key 100. More specifically, when the keycap 2 is pressed to the pressed position P1, that is, the keycap 2 is completely pressed to a lowest position, the middle portion of the bottom surface 2*a* of the keycap 2 presses the resilient member (not shown), and the outer periphery of the bottom surface 2*a* of the keycap 2 contacts the protruding structures 4. Hence, the protruding structures 4 abut against the keycap 2, so that a gap D1/D2 is formed between the keycap 2 and the connection component 3 (as shown in FIGS. 7A and 7B).

More specifically, when the keycap 2 is pressed to the pressed position P1, the first connection member 31 and the second connection member 32 are laterally disposed with respect to the keycap 2, and the first connection member 31 and the second connection member 32 are not in parallel in a side view of the key 100. Moreover, the distance of the gap D2 formed by abutting the keycap 2 with the protruding structures 4 on the second connection member 32 is greater than the distance of the gap D1 formed by abutting the keycap 2 with the protruding structures 4 on the first connection member 31. The thickness of the protruding structure 4 on the second connection member 32 is greater than the thickness of the protruding structure 4 on the first connection member 31, but embodiments are not limited thereto. In some embodiments, the thickness of the protruding structure 4 on the second connection member 32 may be equal to or less than the thickness of the protruding structure 4 on the first connection member 31.

In other words, in this embodiment, the inner surface of the keycap 2 contacts the protruding portion (in a surface-to-point contact manner) on the upper surface 31*a* of the first connection member 31 and the protruding portion (in a surface-to-point contact manner) on the upper surface 32*a* of the second connection member 32. Specifically, it is understood that the components of the key 100 have design tolerance and the components of key 100 are assembled with each other in a loose manner. Hence, after the key 100 is assembled, gaps exist among components of the key 100. As a result, after a key known to the inventor is pressed, noise is generated. Here, for the key 100 according to one or some embodiments of the instant disclosure, after the keycap 2 is pressed, the keycap 2 contacts the protruding structures 4 on the upper surface 31*a* of the first connection member 31 and on the upper surface 32*a* of the second connection member 32 directly, thereby reducing the keystroke noise.

In other words, when the keycap 2 is pressed to a bottom dead point (and the keycap compresses the resilient member (not shown) to a compressed fixed position), the protruding structures 4 on the first connection member 31 and on the second connection member 32 abut against the bottom surface 2*a* of the keycap 2. The first connection member 31 and the second connection member 32 are not in parallel in the side view of the key 100, so the bottom surface 2*a* of the keycap 2 cannot contact the upper surface 31*a* of the first connection member 31 (in a surface-to-surface contact manner) and the upper surface 32*a* of the second connection member 32 (in a surface-to-surface contact manner). Hence, no keystroke noise is generated.

Furthermore, by changing the thickness of the protruding structure 4, by changing the position of the protruding structure 4, or by changing the pivoting positions among the connection component 3, the keycap 2, and the substrate 1, when the keycap 2 is pressed to the pressed position P1, the first connection member 31 and the second connection member 32 can be arranged laterally with respect to the keycap 2 and are not in parallel in a side view of the key 100.

Figure 8A:
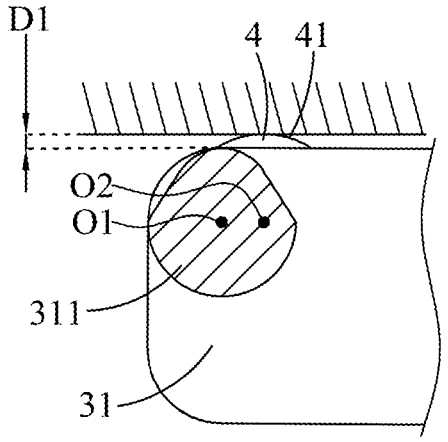
FIG. 8A illustrates a partial side cross-sectional view showing a portion of another embodiment of a first upper shaft portion of the key.
Figure 8B:
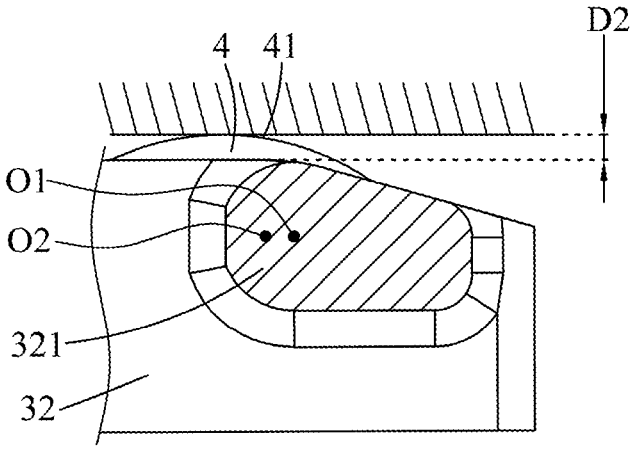
FIG. 8B illustrates a partial side cross-sectional view showing a portion of another embodiment of a second upper shaft portion of the key.

Please refer to FIGS. 1, 2, 7A, and 7B. In this embodiment, the protruding structures 4 are disposed on the end 31*c* of the first connection member 31, and a center point O1 of each of the protruding structures 4 and a center point O1 of the corresponding first upper shaft portion 311 are the same center point, but embodiments are not limited thereto. Please refer to FIGS. 8A and 8B. FIG. 8A illustrates a partial side cross-sectional view showing a portion of another embodiment of the first upper shaft portion 311 of the key 100. FIG. 8B illustrates a partial side cross-sectional view showing a portion of another embodiment of the second upper shaft portion 321 of the key 100. In some embodiments, the center point O2 of each of the protruding structures 4 and the center point O1 of the corresponding first upper shaft portion 311 may be different center points. In this embodiment, as shown in FIGS. 7A and 7B, the center point O1 of each of the protruding structures 4 and the center point O1 of the corresponding first upper shaft portion 311 are the same center point, and the keycap 2 is pivotally connected to the first upper shaft portions 311. Since each of the protruding structures 4 and the corresponding first upper shaft portion 311 have the same center point, when the keycap 2 is moved from an abutted positon P2 to the pressed position P1 or moved from the pressed position P1 to the abutted position P2, the bottom surface 2*a* of the keycap 2 moves along the surface of the curved structure 41 of each of the protruding structures 41, and the bottom surface 2*a* of the keycap 2 continuously contacts the surface of the curved structure 41 of each of the protruding structures 4. More specifically, in this embodiment, as shown in FIGS. 7A and 7B, the protruding structures 4 are disposed on the end 32*c* of the second connection member 32, and a center point O1 of each of the protruding structures 4 and a center point O1 of the corresponding second upper shaft portion 321 are the same center point, but embodiments are not limited thereto. As shown in FIGS. 8A and 8B, in some embodiments, the center point O2 of each of the protruding structures 4 and the center point O1 of the corresponding second upper shaft portion 321 are different center points.

Please refer to FIGS. 1, 2, 6A, 6B, 7A, and 7B. In this embodiment, when the keycap 2 is moved back to the abutted position P2, the bottom surface 2*a* of the keycap 2 contacts the protruding structures 4, so that no gap is formed at a connection portion between the keycap 2 and the protruding structures 4. In the case that the keycap 2 is at the abutted position P2, once a gap exists at the connection portion between the keycap 2 and the protruding structure 4, noise will be generated when the keycap 2 is pressed. In other words, when the keycap 2 is abutted to the top dead point, the keycap 2 closely contacts the protruding structures 4, and the protruding structures 4 form a slight interference fit by contacting the keycap 2, thereby preventing from generating the keystroke noise and thus reducing noise.

Figure 9A:
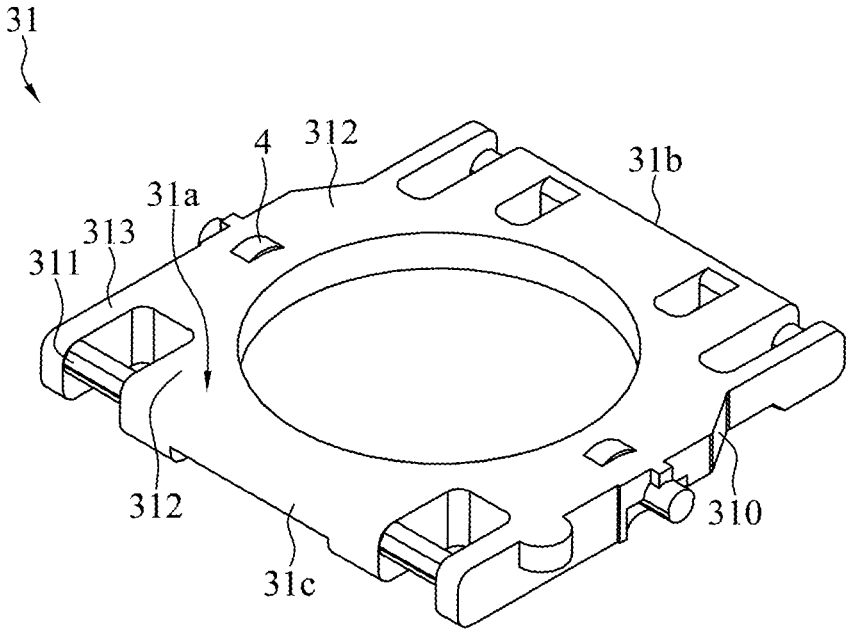
FIG. 9A illustrates a perspective view of a first embodiment of a protruding structure on a first connection member of the key.
Figure 9B:
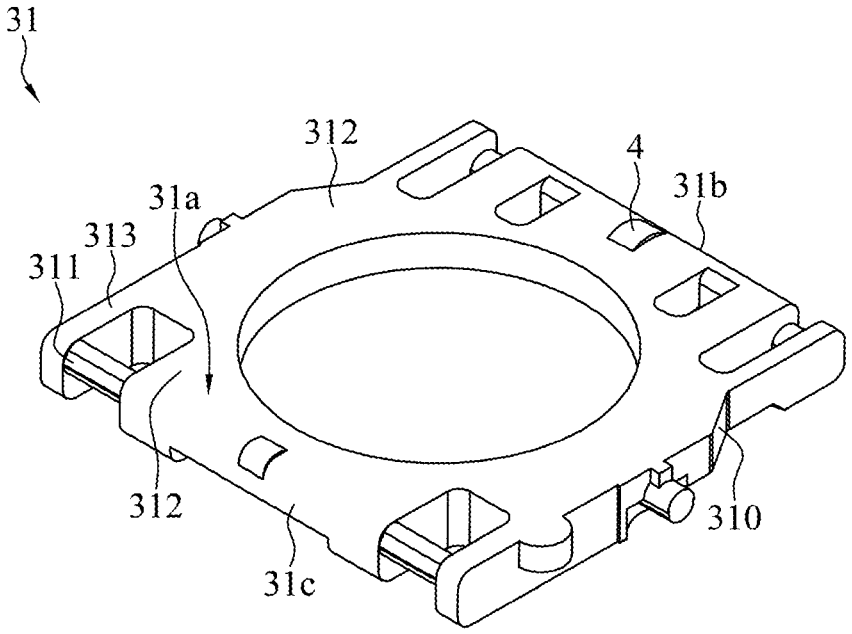
FIG. 9B illustrates a perspective view of a second embodiment of the protruding structure on the first connection member of the key.
Figure 9C:
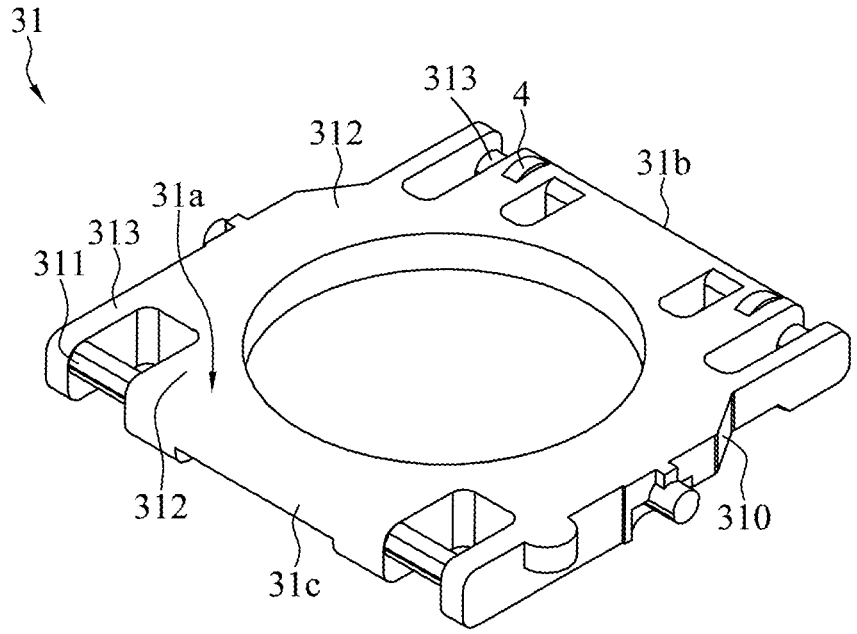
FIG. 9C illustrates a perspective view of a third embodiment of the protruding structure on the first connection member of the key.
Figure 9D:
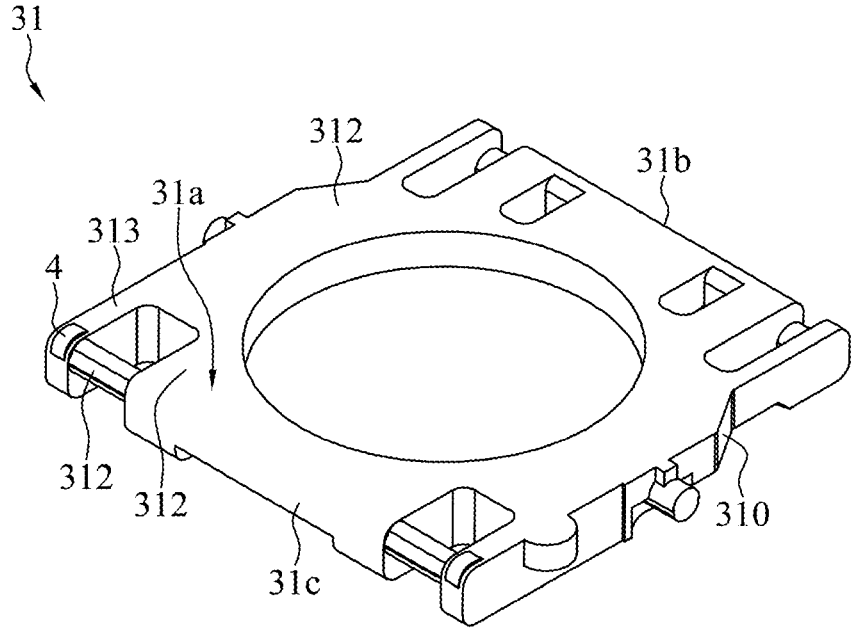
FIG. 9D illustrates a perspective view of a fourth embodiment of the protruding structure on the first connection member of the key.

Please refer to FIGS. 9A, 9B, 9C, and 9D. FIG. 9A illustrates a perspective view of a first embodiment of the protruding structure 4 on the first connection member 31 of the key 100. FIG. 9B illustrates a perspective view of a second embodiment of the protruding structure 4 on the first connection member 31 of the key 100. FIG. 9C illustrates a perspective view of a third embodiment of the protruding structure 4 on the first connection member 31 of the key 100. FIG. 9D illustrates a perspective view of a fourth embodiment of the protruding structure 4 on the first connection member 31 of the key 100. In some embodiments, the protruding structure 4 may be disposed on any portion of the side arms 312 on the upper surface 31*a* of the first connection member 31. That is, the protruding structures 4 may be disposed on any portion of the side arms 312 on the upper surface 31*a* of the inner frame body 310. Moreover, one or more protruding structures 4 may be disposed on the side arm 312.

Please refer to FIG. 9A. In this embodiment, the protruding structures 4 are disposed on a middle portion of the right side arm 312 of the first connection member 31 and on a middle portion of the left side arm 312 of the first connection member 31. When the keycap 2 is pressed to the pressed position P1, the bottom surface 2*a* of the keycap 2 contacts the protruding structures 4, and the protruding structures 4 on the side arms 312 elastically abut against the keycap 2, so that a gap D1/D2 is formed between the keycap 2 and the connection component 3 (as shown in FIGS. 7A and 7B).

Please refer to FIG. 9B. In this embodiment, the protruding structures 4 are disposed on a middle portion of the front side arm 312 (long side arm) of the first connection member 31 and on a middle portion of the rear side arm 312 (short side arm) of the first connection member 32, and a center point O1 of the protruding structure 4 on the long side arm 312 and a center point O1 of the corresponding first upper shaft portion 311 are the same center point. When the keycap 2 is moved from the abutted position P2 to the pressed position P1 or is moved from the pressed position P1 to the abutted position P2, the bottom surface 2*a* of the keycap 2 moves along with the surface of the curved structure 41 of each of the protruding structures 4, and the bottom surface 2*a* of the keycap 2 continuously contacts the surface of the curved structure 41 of each of the protruding structures 4. Moreover, when the keycap 2 is pressed to the pressed position P1, the bottom surface 2*a* of the keycap 2 contacts the protruding structure 4 on the short side arm 312. Due to the structural features of the side arms 312, the protruding structures 4 on the middle portions of the side arms 312 elastically abut against the keycap 2, so that a gap D1/D2 is formed between the keycap 2 and the connection component 3 (as shown in FIGS. 7A and 7B).

Please refer to FIG. 9C. In this embodiment, the protruding structures 4 are disposed on the first connection member 31 and adjacent to inner portions of the first lower shaft portions 313 at two sides of the first connection member 31. The first lower shaft portion 313 is at the corner of the first connection member 31 and corresponds to the adjacent corner of the keycap 2 above the connection component 3. When the corner of the keycap 2 is pressed for testing and when the keycap 2 is pressed to the pressed position P1, the outer periphery of the bottom surface 2*a* of the keycap 2 contacts the protruding structures 4, and the protruding structures 4 abut against the keycap 2, so that a gap D1/D2 is formed between the keycap 2 and the connection component 3 (as shown in FIGS. 7A and 7B).

Please refer to FIG. 9D. In this embodiment, the protruding structures 4 are disposed on the first connection member 31 and adjacent to outer portions of the first upper shaft portions 311 at two sides of the first connection member 31. The first upper shaft portion 311 is at the corner of the first connection member 31 and corresponds to the adjacent corner of the keycap 2 above the connection component 3. When the corner of the keycap 2 is pressed for testing and when the keycap 2 is pressed to the pressed position P1, the outer periphery of the bottom surface 2*a* of the keycap 2 contacts the protruding structures 4, and the protruding structures 4 abut against the keycap 2, so that a gap D1/D2 is formed between the keycap 2 and the connection component 3 (as shown in FIGS. 7A and 7B). Moreover, when the keycap 2 is moved from the abutted position P2 to the pressed position P1 or is moved from the pressed position P1 to the abutted position P2, the bottom surface 2*a* of the keycap 2 moves along with the surface of the curved structure 41 of each of the protruding structures 4, and the bottom surface 2*a* of the keycap 2 continuously contacts the surface of the curved structure 41 of each of the protruding structures 4, so that a gap D1/D2 is formed between the keycap 2 and the connection component 3 (as shown in FIGS. 7A and 7B).

Figure 10A:
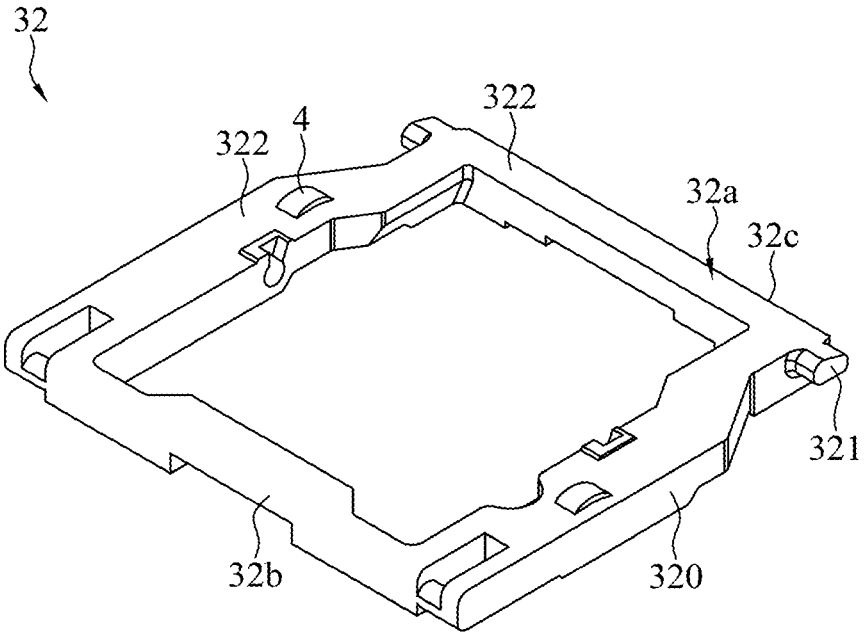
FIG. 10A illustrates a perspective view of a first embodiment of a protruding structure on a second connection member of the key.
Figure 10B:
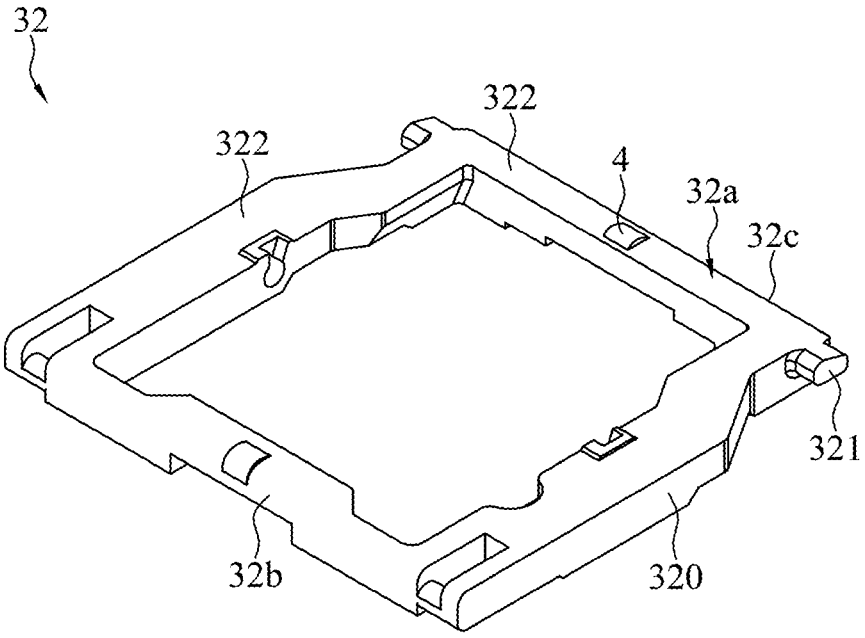
FIG. 10B illustrates a perspective view of a second embodiment of the protruding structure on the second connection member of the key.
Figure 10C:
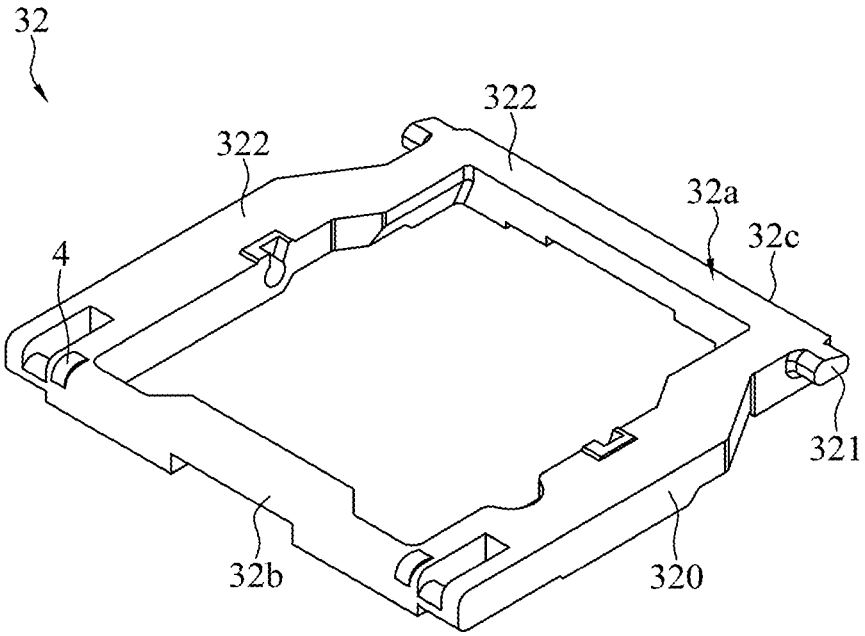
FIG. 10C illustrates a perspective view of a third embodiment of the protruding structure on the second connection member of the key.
Figure 10D:
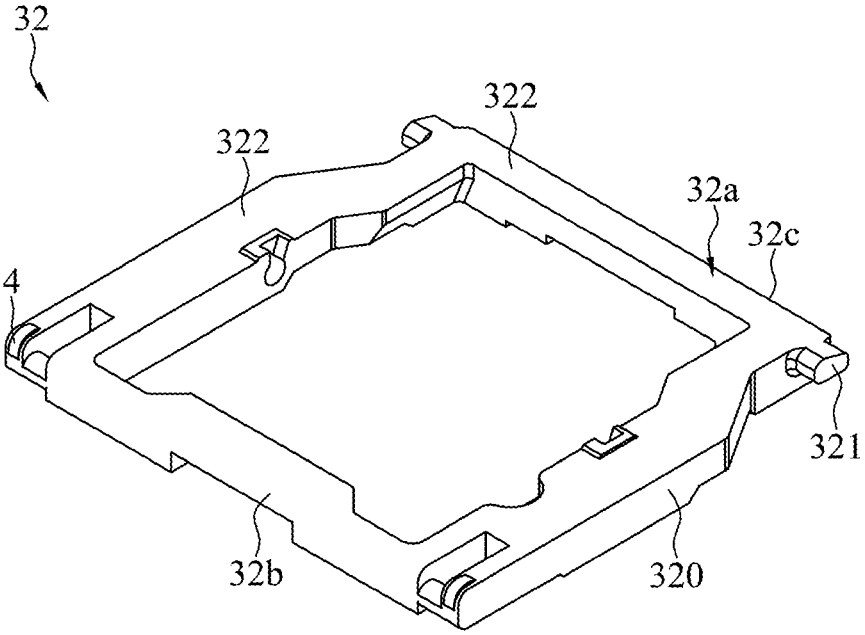
FIG. 10D illustrates a perspective view of a fourth embodiment of the protruding structure on the second connection member of the key.

Please refer to FIGS. 10A, 10B, 10C, and 10D. FIG. 10A illustrates a perspective view of a first embodiment of a protruding structure 4 on a second connection member 32 of the key 100. FIG. 10B illustrates a perspective view of a second embodiment of the protruding structure 4 on the second connection member 32 of the key 100. FIG. 10C illustrates a perspective view of a third embodiment of the protruding structure 4 on the second connection member 32 of the key 100. FIG. 10D illustrates a perspective view of a fourth embodiment of the protruding structure 4 on the second connection member 32 of the key 100. In some embodiments, the protruding structure 4 may be disposed on any portion of the side arms 322 on the upper surface 32*a* of the second connection member 32. That is, the protruding structures 4 may be disposed on any portion of the side arms 322 on the upper surface 32*a* of the outer frame body 320. Moreover, one or more protruding structures 4 may be disposed on the side arm 322.

Please refer to FIG. 10A. In this embodiment, the protruding structures 4 are disposed on the a portion adjacent to a middle portion of the right side arm 322 of the second connection member 32 and on a portion adjacent to a middle portion of the left side arm 322 of the second connection member 32. When the keycap 2 is pressed to the pressed position P1, the bottom surface 2*a* of the keycap 2 contacts the protruding structures 4. Due to the structural features of the side arms 322, the protruding structures 4 on the portions adjacent to the middle portions of the side arms 322 elastically abut against the keycap 2, so that a gap D1/D2 is formed between the keycap 2 and the connection component 3 (as shown in FIGS. 7A and 7B).

Please refer to FIG. 10B. In this embodiment, the protruding structures 4 are disposed on a middle portion of the front side arm 322 (short side arm) of the second connection member 32 and on a middle portion of the rear side arm 322 (long side arm) of the second connection member 32, and a center point O1 of the protruding structure 4 on the short side arm 322 and a center point O1 of the corresponding second upper shaft portion 321 are the same center point. When the keycap 2 is moved from the abutted position P2 to the pressed position P1 or is moved from the pressed position P1 to the abutted position P2, the bottom surface 2*a* of the keycap 2 moves along with the surface of the curved surface 41 of each of the protruding structures 4, and the bottom surface 2*a* of the keycap 2 continuously contacts the surface of the curved surface 41 of each of the protruding structures 4. Moreover, when the keycap 2 is pressed to the pressed position P1, the bottom surface 2*a* of the keycap 2 contacts the protruding structure 4 on the long side arm 322. The protruding structures 4 on the side arms 322 elastically abut against the keycap 2, so that a gap D1/D2 is formed between the keycap 2 and the connection component 3 (as shown in FIGS. 7A and 7B).

Please refer to FIG. 10C. In this embodiment, the protruding structures 4 are disposed on the second connection member 32 and adjacent to inner portions of the second lower shaft portions 323 at two sides of the second connection member 32. The second lower shaft portion 323 is at the corner of the second connection member 32 and corresponds to the adjacent corner of the keycap 2 above the connection component 3. When the corner of the keycap 2 is pressed for testing and when the keycap 2 is pressed to the pressed position Pb, the outer periphery of the bottom surface 2*a* of the keycap 2 contacts the protruding structures 4, and the protruding structures 4 abut against the keycap 2, so that a gap D1/D2 is formed between the keycap 2 and the connection component 3 (as shown in FIGS. 7A and 7B).

Please refer to FIG. 10D. In this embodiment, the protruding structures 4 are disposed on the second connection member 32 and adjacent to outer portions of the second upper shaft portions 321 at two sides of the second connection member 32. The second upper shaft portion 321 is at the corner of the second connection member 32 and corresponds to the adjacent corner of the keycap 2 above the connection component 3. When the corner of the keycap 2 is pressed for testing and when the keycap 2 is pressed to the pressed position P1, the outer periphery of the bottom surface 2*a* of the keycap 2 contacts the protruding structures 4, and the protruding structures 4 abut against the keycap 2, so that a gap D1/D2 is formed between the keycap 2 and the connection component 3 (as shown in FIGS. 7A and 7B). Moreover, when the keycap 2 is moved from the abutted position P2 to the pressed position P1 or is moved from the pressed position P1 to the abutted position P2, the bottom surface 2*a* of the keycap 2 moves along with the surface of the curved structure 41 of each of the protruding structures 4, and the bottom surface 2*a* of the keycap 2 continuously contacts the surface of the curved structure 41 of each of the protruding structures 4, so that a gap D1/D2 is formed between the keycap 2 and the connection component 3 (as shown in FIGS. 7A and 7B).

Please refer to FIGS. 9A to 10D. In some embodiments, the protruding structures 4 may be disposed on the upper surface 32*a* of the outer frame body 320 and on the side arms 322 of the outer frame body 320 and disposed on the upper surface 31*a* of the inner frame body 310 and on the side arms 312 of the inner frame body 310.

Figure 11A:
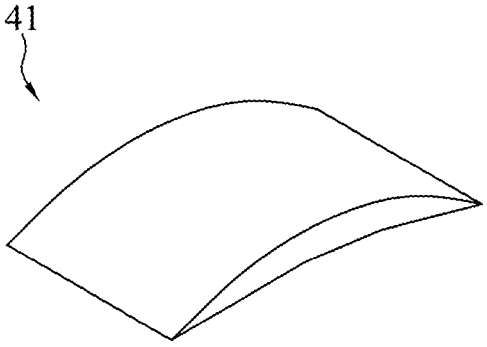
FIG. 11A illustrates a perspective view of a first embodiment of a protruding structure of the key.
Figure 11B:
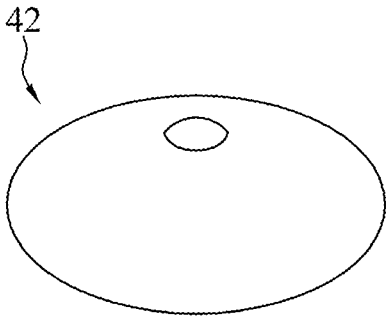
FIG. 11B illustrates a perspective view of a second embodiment of the protruding structure of the key.
Figure 11C:
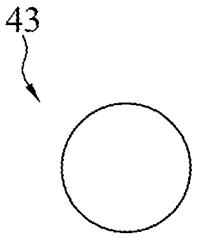
FIG. 11C illustrates a perspective view of a third embodiment of the protruding structure on the second connection member of the key.

Please refer to FIGS. 11A to 11C. FIG. 11A illustrates a perspective view of a first embodiment of a protruding structure 4 of the key 100. FIG. 11B illustrates a perspective view of a second embodiment of the protruding structure 4 of the key 100. FIG. 11C illustrates a perspective view of a third embodiment of the protruding structure 4 of the key 100. In this embodiment, the protruding structure 4 is a curved structure 41 for an illustrative example, but embodiments are not limited thereto. In some embodiment, the protruding structure 4 may be a circular cone structure 42 or a sphere structure 43 (parts of the sphere structure 43 protrudes from the upper surface 31*a* or the upper surface 32*a* of the connection component 3). The protruding structure 4 with the curved structure 41, the circular cone structure 42, or the sphere structure 43 contacts the bottom surface 2*a* of the keycap 2 in a point-contact manner, but embodiments are not limited thereto. The bottom surface 2*a* of the keycap 2 contacts the curved structure 41, the circular cone structure 42, or the sphere structure 43 on the upper surface 31*a* of the first connection member 31 (in a surface-to-point contact manner) and contacts the curved structure 41, the circular cone structure 42, or the sphere structure 43 on the upper surface 32*a* of the second connection member 32 (in a surface-to-point contact manner), such that the noise can be reduced.

Figure 11D:
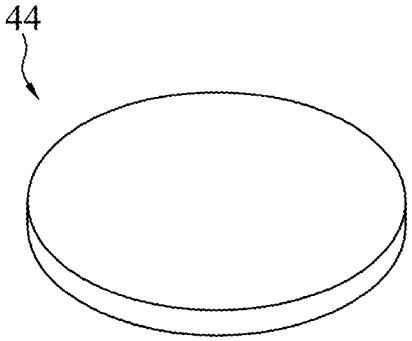
FIG. 11D illustrates a perspective view of a fourth embodiment of the protruding structure of the key.

Please refer to FIG. 11D. FIG. 11D illustrates a perspective view of a fourth embodiment of the protruding structure 4 of the key 100. In some embodiments, the protruding structure 4 may be a circular cylinder structure 44, and the circular cylinder structure 44 of the protruding structure 4 contacts the bottom surface 2*a* of the keycap 2 in a surface-contact manner, rather than in a point-contact manner, but embodiments are not limited thereto. The bottom surface 2*a* of the keycap 2 contacts the circular cylinder structure 44 on the upper surface 31*a* of the first connection member 31 (in a surface-to-surface contact manner) and contacts the circular cylinder structure 44 on the upper surface 32*a* of the second connection member 32 (in a surface-to-surface contact manner), such that the noise can be reduced.

Figure 11E:
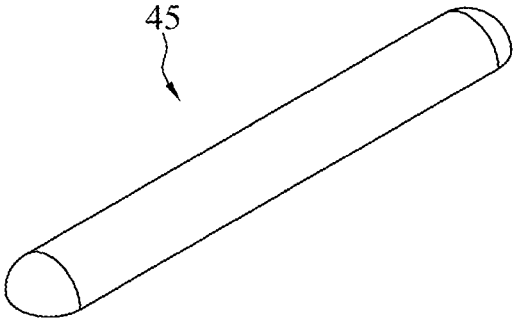
FIG. 11E illustrates a perspective view of a fifth embodiment of the protruding structure on the second connection member of the key.

Please refer to FIG. 11E. FIG. 11E illustrates a perspective view of a fifth embodiment of the protruding structure 4 of the key 100. In some embodiments, the protruding structure 4 may be an elongated rib structure 45, and the elongated rib structure 45 of the protruding structure 4 contacts the bottom surface 2*a* of the keycap 2 in a line-contact manner, rather than a surface-contact manner. The bottom surface 2*a* of the keycap 2 contacts the elongated rib structure 45 on the upper surface 31*a* of the first connection member 31 (in a surface-to-line contact manner) and contacts the elongated rib structure 45 on the upper surface 32*a* of the second connection member 32 (in a surface-to-line contact manner), such that the noise can be reduced.

According to one or some embodiments, the protruding structures 4 and the connection component 3 may be integrally formed with each other, but embodiments are not limited thereto. In some embodiments, the protruding structures 4 may be coated on the connection component 3 or assembled on the connection component 3.

According to one or some embodiments of the instant disclosure, when the keycap is pressed to the pressed position, the protruding structures on the first connection member and the second connection member abut against the bottom surface of the keycap, and the protruding structures abut against the keycap, so that a gap is formed between the keycap and the connection component. Hence, the bottom surface of the keycap cannot contact the upper surface of the first connection member and the upper surface of the second connection member, so that the stroke noise generated by the contact between surfaces can be prevented. Accordingly, the stroke noise can be reduced. Moreover, when the keycap is at the abutted position, the bottom surface of the keycap contacts the protruding structures, so that no gap is formed at a connection portion between the keycap and the protruding structures, thereby reducing the stroke noise.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A key comprising:

a substrate;

a keycap on the substrate;

a connection component comprising a first connection member and a second connection member, wherein the first connection member and the second connection member are between the substrate and the keycap, wherein one of two ends of the first connection member is connected to the substrate, and the other end of the first connection member is connected to the keycap, and wherein one of two ends of the second connection member is connected to the substrate, and the other end of the second connection member is connected to the keycap; wherein the first connection member comprises an inner frame body, and the second connection member comprises an outer frame body; and a plurality of protruding structures, wherein the protruding structures are disposed on an upper surface of the first connection member, or the protruding structures are disposed on an upper surface of the second connection member, or the protruding structures are disposed on the upper surface of the first connection member and on the upper surface of the second connection member, and wherein each of the protruding structures faces a bottom surface of the keycap, wherein the protruding structures are disposed on an upper surface of the inner frame body and on side arms of the inner frame body, or the protruding structures are disposed on the upper surface of the inner frame body and on the side arms of the inner frame body and are disposed on the upper surface of the outer frame body and on the side arms of the outer frame body, and the each of the protruding structures do not contact to another one;

wherein when the keycap is pressed to a pressed position, the bottom surface of the keycap contacts the protruding structures, and the protruding structures abut against the keycap, so that a gap is formed between the keycap and the connection component, and wherein the second connection member has a hollow portion for receiving the first connection member.

2. The key according to claim 1, wherein each of the protruding structures contacts the bottom surface of the keycap in a point-contact manner, in a line-contact manner, or in a surface-contact manner.

3. The key according to claim 1, wherein each of the protruding structures is a curved structure, a circular cone structure, a sphere structure, a circular cylinder structure, or a elongate rib structure.

4. The key according to claim 1, wherein when the keycap is pressed to the pressed position, the first connection member and the second connection member are arranged laterally with respect to the keycap and are not in parallel in a side view of the key.

5. The key according to claim 1, wherein two sides of the other end of the first connection member have two first upper shaft portions, two sides of the other end of the second connection member have two second upper shaft portions, the first upper shaft portions are respectively assembled with pivoting holes of the keycap, and the second upper shaft portions are respectively assembled with reversed hooks of the keycap.

6. The key according to claim 5, wherein the protruding structures are disposed on the upper surface the first connection member and adjacent to the first upper shaft portions, or the protruding structures are disposed on the upper surface of the second connection member and adjacent to the second upper shaft portions, or the protruding structures are disposed on the upper surface of the first connection member and adjacent to the first upper shaft portions and are disposed on the upper surface of the second connection member and adjacent to the second upper shaft portions.

7. The key according to claim 5, wherein the protruding structures are disposed on the other end of the first connection member, and a center point of each of the protruding structures and a center point of the corresponding first upper shaft portion are a same center point or are different center points.

8. The key according to claim 5, wherein the protruding structure are disposed on the other end of the second connection member, and a center point of each of the protruding structures and a center point of the corresponding second upper shaft portion are a same center point or are different center points.

9. The key according to claim 1, wherein when the keycap is at an abutted position, the bottom surface of the keycap contacts the protruding structures, and the protruding structure contact the keycap, so that no gap is formed at a connection portion between the keycap and the protruding structures.

10. The key according to claim 9, wherein when the keycap is moved from the abutted position to the pressed position, the bottom surface of the keycap continuously contacts a surface of a curved structure of each of the protruding structures.

* * * * *